United States Patent [19]

Swan

[11] 4,197,140

[45] Apr. 8, 1980

[54] PROCESS FOR CLEANING INTERNAL COMBUSTION ENGINE CYLINDERS

[76] Inventor: John C. Swan, 1610 Preston La., Morro Bay, Calif. 93442

[21] Appl. No.: 959,710

[22] Filed: Nov. 13, 1978

[51] Int. Cl.[2] ..... B08B 3/10

[52] U.S. Cl. ..... 134/20; 134/39; 134/40; 123/198 A

[58] Field of Search ..... 134/20, 23, 39, 40; 123/198 A, 198 F, 1 A

[56] References Cited

U.S. PATENT DOCUMENTS

| | | | |
|---|---|---|---|
| 2,251,988 | 8/1941 | Curran | 134/20 |
| 2,641,267 | 6/1953 | Faulkner | 134/20 |
| 2,741,596 | 4/1956 | Luark et al. | 134/40 X |
| 2,881,102 | 4/1959 | Lidecker | 134/20 |

FOREIGN PATENT DOCUMENTS

| | | | |
|---|---|---|---|
| 163213 | 7/1953 | Australia | 134/39 |
| 246197 | 2/1961 | Australia | 134/20 |

*Primary Examiner*—Richard V. Fisher
*Attorney, Agent, or Firm*—Thomas E. Schatzel

[57] ABSTRACT

An improved process for cleaning internal combustion cylinders including disconnecting the ignition mechanisms of preselected cylinders, introducing a combustible cleaning solvent mixture into the fuel intake, running the engine for a period of time, then repeating the process until each cylinder has been treated while its associated ignition mechanism is inoperative and finally running the engine to combust and exhaust all of the cleaning solvent mixture.

1 Claim, 9 Drawing Figures

PROCESS FOR CLEANING INTERNAL COMBUSTION ENGINE CYLINDERS

BACKGROUND OF THE INVENTION

1. Field of the Invention

This invention relates generally to cleaning processes and more specifically to processes for cleaning the interior of the combustion cylinders of internal combustion engines.

2. Description of the Prior Art

Most of the world's mechanically powered transportation and a significant portion of the other power sources used by mankind are dependent upon the reciprocating internal combustion engine. This engine contains cylinders in which the power comes from pistons driven by the combustion of petroleum products or other combustibles. Compression is maintained in the cylinders, in part, by piston rings which provide a sliding contact surface between the pistons and the cylinder walls.

Due to the fact that fuels used for combustion in these engines are not entirely combustible, deposits known as tar or glaze gradually build up in the interior walls of the cylinders, the surfaces of the pistons and rings and the valves which allow fuel into the cylinders. This buildup causes a reduction in the efficiency of the engine and can also allow lubricating oil, normally maintained in the area below the piston rings, to enter the cylinder and to be combusted. In this manner, lubricating oil is used up in the combustion process and must be replaced in order to avoid friction damage to the moving parts of the engine.

Many attempts have been made throughout the years to alleviate the problems caused by the buildup of tar and glaze and the burning of lubrication oil in engines. Some of these methods have included ways of removing the glaze and tar from the cylinder walls, pistons and rings in order to provide for clean surfaces upon which the rings may slide and thus increase compression and prevent the entry of lubrication oils into the cylinders. Two of these prior art methods are illustrated in U.S. Pat. Nos. 2,251,988 and 2,881,102, issued to *A. F. Curran* and *V. E. Lidecker,* respectively.

Although most of the prior art methods of cleaning the cylinders require disassembly of the engine, the above-mentioned references and the present invention clean the cylinders while the engine is essentially intact. A difficulty encountered in all the prior art methods of cleaning cylinder walls is that either the engine must be taken apart and the pieces soaked in the cleaning mixture or the cleaning mixture is introduced directly into the cylinders in such a manner that it is predominately burned away before it can totally permeate the tar and glaze.

SUMMARY OF THE PRESENT INVENTION

It is therefore an object of the present invention to provide an improved means for cleaning the tar and glaze from the interiors of combustion cylinders without disassembling the engine.

It is a further object of the present invention to provide a means for allowing the cleaning mixture to be turbulently in contact with the interior surfaces of interior combustion engine cylinders, pistons and piston rings over a period of time.

Briefly, the present invention is a process for cleaning the interior of internal combustion engine cylinders without disassembling the engine to any major degree. The process involves running the engine with half or less of its cylinders having their associated spark plugs disconnected, pouring a cleaning mixture into the carburetor and continuing the running of the engine for several minutes, then stopping the engine, disconnecting some or all of the spark plugs of the remaining cylinders, reconnecting the originally disconnected cylinders and then repeating the process, again pouring a certain amount of the cleaning mixture through the engine until each cylinder has been treated with its spark plug disconnected. After the mixture has been poured through each of the cylinders having its spark plug disconnected at least once, the engine is then run with all spark plugs reconnected for a period of time such that all of the cleaning mixture is exhausted from the system.

An advantage of the present invention is that the mixture is delivered into some cylinders in which there is no ignition of fuel but wherein the pistons are still being operated by the operation of the active cylinders and the drive shaft so as to provide a turbulent scrubbing action of the mixture on the cylinder walls.

Another advantage of the present invention is that the only disassembly of the engine which is required is exposing the carburetor throat so that the cleansing mixture may be poured into it or such other method of simply introducing the mixture into the fuel intake as is feasible with the particular engine.

A further advantage of the present invention is that it provides a superior means for removing glaze and dissolving tar from the inside of the cylinders.

Still another advantage of the present invention is that the cleaning mixture utilized is made up of relatively inexpensive, commonly available chemicals which have no significant deleterious environmental effects.

These and other objects and advantages of the present invention will no doubt become apparent after reading the following detailed description of the process and the illustrations of the process in the several figures of the drawing.

IN THE DRAWING

FIGS. 1*a*–1*b*''' illustrate various types of cylinder arrangements on internal combustion engines and arrangements of spark plug connections in successive steps of a preferred utilization of the process; and FIG. 2 is a flow chart illustrating the various steps in a preferred utilization of the process.

DETAILED DESCRIPTION OF THE PREFERRED UTILIZATION

Figure 1A:
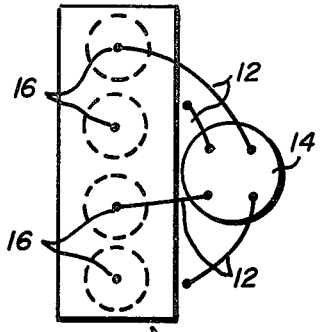
Figure 1B:
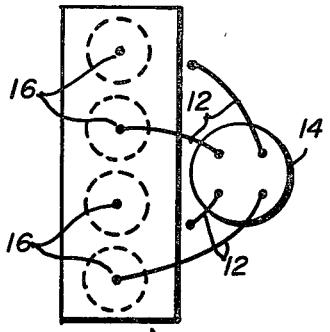
Figure 1A:
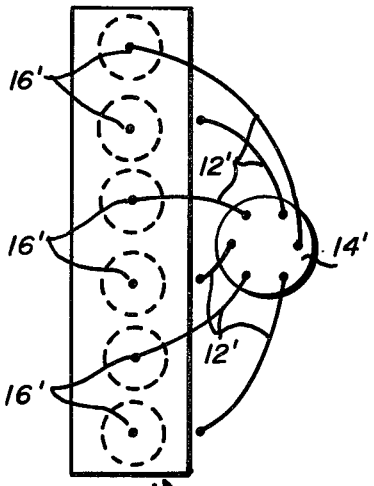
Figure 1B:
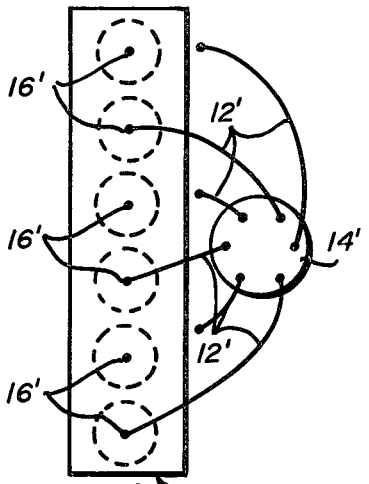
Figure 1A:
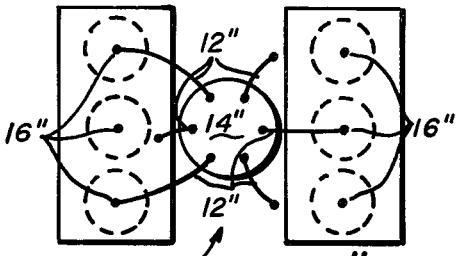
Figure 1A:
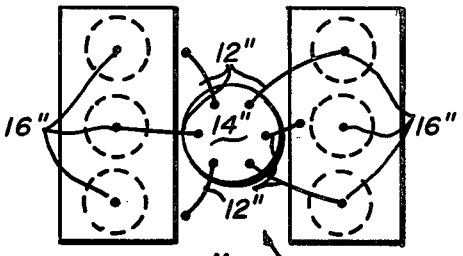
Figure 1A:
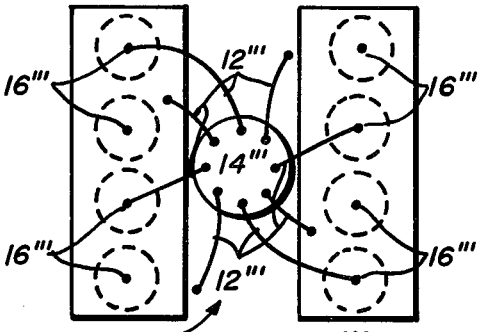
Figure 1B:
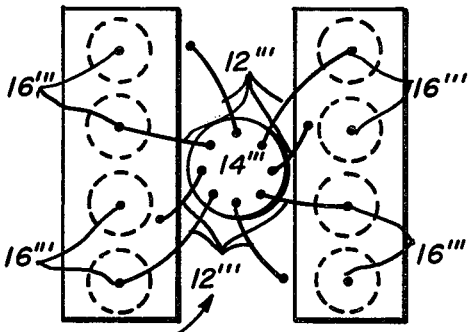

Referring to FIGS. 1*a*–1*b*''', common types of cylinder arrangements within internal combustion engines are diagrammatically illustrated. Each diagram represents an engine referred to by the general reference character 10. A fanciful illustration of the means in which spark plug wires 12 are connected from a distributor 14 to spark plugs 16 of the various cylinders are also shown with alternately connected cylinders being illustrated in Part a of the figure of each engine configuration and the opposite configuration being illustrated in Part b of the figure of that particular configuration. Shown in FIGS. 1*a*–1*b*''' are illustrations of engine configurations wherein the four cylinders are arranged in a straight line as illustrated in FIGS. 1*a* and 1*b;* six cylinders arranged in a straight line as illustrated in FIGS. 1a' and 1b'; six cylinders arranged in a "V" pattern as illustrated in FIGS. 1a'' and 1b''; and eight cylinders arranged in a "V" pattern as illustrated in FIGS. 1a''' and 1b'''. It is to be understood that the present invention is applicable to all manner of reciprocating internal combustion engines and not merely to those illustrated; however, these four configurations are the most commonly used configurations and are chosen for the purpose of illustration.

Figure 2:
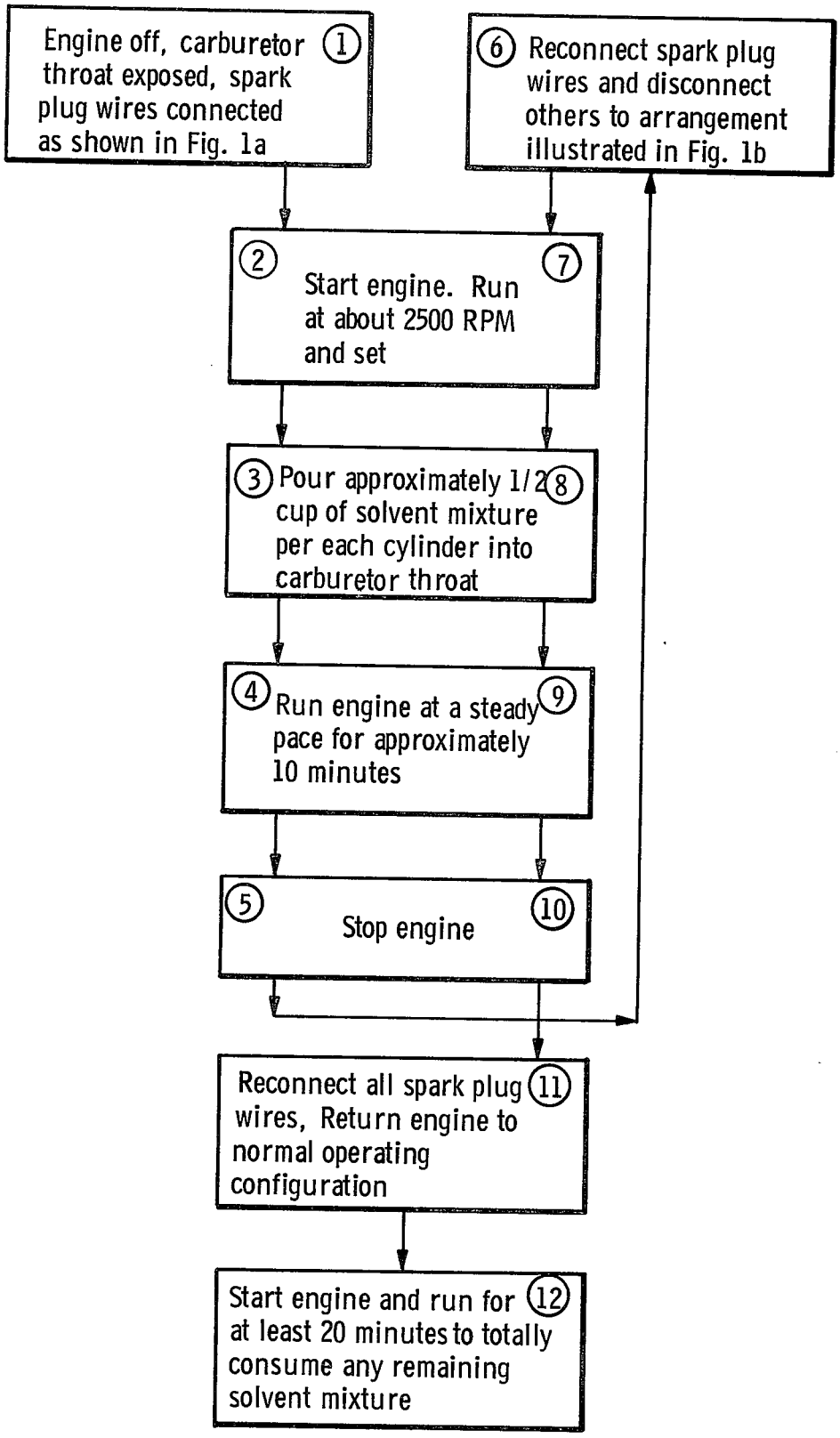

Referring to FIG. 2, a flow chart illustrates the various steps in the preferred utilization of the process in their proper order. The entire process as used on a typical internal combustion engine mounted in an automobile is illustrated here.

Step 1 of the process involves initially preparing the engine by removing the air cleaner and other equipment necessary to expose the carburetor throat such that liquid may be poured directly into the fuel intake system either at the carburetor or at some point other than into the gas tank where the solvent cleaning mixture would be diluted by the gasoline to the point of uselessness. After this has been done, alternate spark plugs in the engine are disconnected by pulling the spark plug wires as shown in FIGS. 1a; 1a'; 1a'' and 1a''' for the particular type of engine being treated. The arrangement at the disconnection of the cylinders is chosen so as to achieve the minimum disruptive torques and forces on the engine block caused by the operation of the engine on only half of its cylinders. For nonstandard firing orders, the arrangement of operational and nonoperational spark plugs may have to be different from those shown in FIG. 1 in order to achieve such minimum.

Once this has been done, Step 2, starting the engine, in undertaken. It is preferable to start the engine running on only half of the cylinders, but in some cases this may be difficult and it may be necessary to start the engine with more than half the spark plugs connected and then pull the spark plug wires after the engine has been started. If this is the case, great care must be used to avoid electrical shock caused by the high voltage being carried through the spark plug wires from the ignition system. Once the engine has been started, it should be set to run at a relatively constant engine speed. The revolutions per minute ("rpms") should be sufficient to keep the engine running with no difficulty, but not so high as to use excess fuel. It has been found that an acceptable figure for most engines is approximately 2500 rpm.

Step 3 involves the pouring of the solvent mixture into the fuel intake mechanism of the engine. With the engine running at approximately 2500 rpm, a certain amount of the combustible cleaning solvent mixture is poured into the carburetor. It is necessary that the solvent mixture be made up of combustible liquids which can dislodge and/or dissolve tar and glaze within the cylinders. The preferred mixture is a combination of kerosene and acetone, and the preferred embodiment of the mixture is two parts by volume kerosene for each part acetone. In other words, the percentage by volume of kerosene in the mixture is between fifty and sixty-seven percent. Further ingredients such as benzene or other combustible organic solvents may be additives. However, due to the possible toxicity of these alternative substances themselves or of their combustion products, the simple combination of kerosene and acetone is recommended. The recommended amount of solvent to be poured into the carburetor during this step is approximately ½ cup per cylinder; that is, for a four-cylinder engine this step would involve the use of one pint of the solvent mixture whereas for an eight-cylinder engine, approximately one quart would be the appropriate amount.

After all of the solvent mixture has been poured through the carburetor, Step 4, that of running the engine at the steady engine speed of about 2500 rpm for approximately ten minutes, is done. While the engine is thus being run, the solvent mixture which was introduced into these cylinders in which the spark plugs were operating is immediately combusted by sparks and thus has very little opportunity to effect the tar and glaze. However, the solvent mixture delivered to the cylinders in which the spark plugs had been disconnected is not combusted and is sloshed up and down in the cylinder by the piston motion. This turbulent motion of the piston causes a scrubbing action within the cylinder which allows the solvent to maximally react with and dissolve the tar and glaze on the cylinder walls of the piston, around the piston rings and on the valves.

Step 5 consists of stopping the engine after ten minutes have elapsed.

Step 6 consists of rearranging the connection of the spark plug wires from the configuration of Part a of FIG. 1 to the configuration of Part b of FIG. 1. This results in the spark plugs which were previously operative now being disconnected with the associated cylinders subject to treatment with the solvent while the previously treated cylinders will now have operative spark plugs which will burn out the solvent and gasoline which has accumulated in them during the previous steps.

Steps 7, 8, 9 and 10 consist of repeating in order Steps 2, 3, 4 and 5.

With the engine stopped after Step 10, Step 11 is to reconnect all the spark plug wires, replace the air cleaner or otherwise reassemble the engine such that it is in its normal operating configuration.

The 12th and final step in the process is to immediately restart the engine and run for at least 20 minutes to thoroughly exhaust any remaining solvent mixture which might be in the engine. This step may be accomplished by actually driving the automobile or by allowing it to run at a steady pace as in Steps 4 and 9.

Informal tests of this process over a lengthy period of time have indicated that it is extremely valuable in cleansing the tar and glaze from interior of combustion cylinders. Automobiles which have had major problems with burning lubrication oil have improved drastically in this regard after being treated by the process of the present invention. In one instance, an automobile which had burned three quarts of motor oil in the previous 17 miles was treated with the process and thereafter did not burn any appreciable amount of motor oil.

It is also possible to use this process to detect problems such as a broken piston ring in a cylinder. Loss of compression in a cylinder is often attributable to the buildup of glaze and tar in the cylinder. However, since the amount of such glaze and tar is significantly reduced by this process, a compression test taken on the individual cylinder both before and after the utilization of this process can indicate to the mechanic in which cylinders compression loss in the engine is attributable to some cause other than buildup of glaze and tar. Since the most common alternate cause is a broken piston ring, it can then be deduced which repair is necessary.

As long as the preferred solvent mixture and the preferred utilization of the process are used, there is no appreciable contamination of either the atmosphere or the engine caused by this process. The solvent mixture is entirely composed of components which are readily combusted by the spark plugs in the cylinders and which can be totally exhausted from the engine by the simple expedient of operating the cylinders in which the solvent mixture is introduced. The preferred solvent mixture of kerosene and acetone produces no harmful combustion byproducts under normal conditions. Furthermore, both acetone and kerosene are readily available, relatively inexpensive materials.

Although the present invention has been described above in terms of the presently preferred utilization of the process, it is to be understood that such disclosure is not to be considered as limiting. Accordingly, it is intended that the appended claims be interpreted as covering all alterations and modifications as fall within the true spirit and scope of the invention.

What is claimed is:

1. A method for cleaning the interior of internal combustion engine cylinders comprising:

rendering the ignition mechanisms of a first predetermined group of cylinders inoperative, said first group numbering one-half of the total number of cylinders and has its members arranged so as to provide for a minimum of disruptive forces and torques upon the engine block caused by the operation of the engine with the ignition mechanisms of said first group of cylinders being inoperative;

operating the engine at a relatively constant engine speed of approximately 2500 revolutions per minute;

introducing a combustible solvent mixture directly into the carburetor of the engine, said mixture being comprised of kerosene and acetone with the percentage by volume of kerosene in said mixture being between fifty and sixty-seven percent, and the amount of said mixture introduced equaling approximately one-half cup times the total number of cylinders in the engine;

causing the engine to continue to operate at said relatively constant engine speed for a period of time of approximately ten minutes;

terminating the operation of the engine;

reactivating the ignition mechanisms of said first group of cylinders;

rendering the ignition mechanisms of a second predetermined group of cylinders inoperative, said second group of cylinders numbering one-half the total number of cylinders and excluding all members of said first group;

repeating said engine operation, introduction, continued operation, termination and reactivation steps;

causing the engine to be in its normal operating condition; and operating the engine for at least twenty minutes so as to eliminate any of said combustible solvent mixture remaining in the cylinders.

* * * * *